US011823512B1

(12) United States Patent
Nguyen

(10) Patent No.: US 11,823,512 B1
(45) Date of Patent: Nov. 21, 2023

(54) SMART ACCESS CONTROL SYSTEM USING AN ELECTRONIC CARD

(71) Applicant: MK GROUP JSC, Hanoi (VN)

(72) Inventor: Khang Trong Nguyen, Hanoi (VN)

(73) Assignee: MK GROUP JSC, Hanoi (VN)

( * ) Notice: Subject to any disclaimer, the term of this patent is extended or adjusted under 35 U.S.C. 154(b) by 0 days.

(21) Appl. No.: 17/899,419

(22) Filed: Aug. 30, 2022

(51) Int. Cl.
*G07C 9/00* (2020.01)
*G07C 9/33* (2020.01)
*G07C 9/29* (2020.01)

(52) U.S. Cl.
CPC ..... *G07C 9/00571* (2013.01); *G07C 9/29* (2020.01); *G07C 9/33* (2020.01)

(58) Field of Classification Search
CPC ..... G07C 9/00571; G07C 9/29; G07C 9/33
See application file for complete search history.

(56) References Cited

U.S. PATENT DOCUMENTS 6,179,205 B1 * 1/2001 Sloan ..... G07F 7/0886 902/4
7,475,812 B1 * 1/2009 Novozhenets ..... G07C 9/21 235/382

* cited by examiner

*Primary Examiner* — Daniell L Negron
(74) *Attorney, Agent, or Firm* — Hamre, Schumann, Mueller & Larson, P.C.

(57) ABSTRACT

A system adapted to interact with an electronic card includes a server and an electronic lock device. The electronic lock device is configured to switch between a locked state and an unlocked state. The server, in response to an access request associated with the electronic card, generates and transmits an access code to the electronic lock device. The electronic lock device is configured to, in response to an input code, compare the input code with the access code, receive input data from a user, access the electronic card to obtain identifying data, and, when the input code is identical to the access code and the input data matches the identifying data, switch to the unlocked state.

8 Claims, 2 Drawing Sheets

SMART ACCESS CONTROL SYSTEM USING AN ELECTRONIC CARD

FIELD

The disclosure relates to a smart access control system using an electronic card.

BACKGROUND

Conventionally, the field of access control (AC) relates to restriction on access to a specific location (e.g., an administrative agency, an office, a private home, etc.). Typically, in order to gain access to the specific location, a visitor is required to carry out a visit application to obtain a means for access such as a visitor card, an access code, etc. The visit application may be implemented manually with a security guard, and may involve writing the name of the visitor on a guest book or other operations.

Also, the use of electronic locks (also known as smart locks) has become increasingly prominent. A typical electronic lock may be unlocked using as an electronic chip, a manually inputted access code, a biometric feature such as a fingerprint, or other means. In some cases, when an entrance of the specific location is provided with an electronic lock, the visitor card may be used for unlocking the electronic lock.

SUMMARY

The object of the disclosure is to provide a smart access control system that employs an electronic card and that is less complex to use.

According to one embodiment of the disclosure, the smart access control system is adapted to interact with an electronic card that stores a card number and identifying data associated with an owner of the electronic card. The smart access control system includes:

- a server configured to communicate with an electronic device; and
- an electronic lock device communicating with the server, the electronic lock device including an input interface, a processor, and a locking mechanism that is configured to switch between a locked state and an unlocked state.

The server is configured to, in response to receipt from the electronic device of an access request that is associated with the electronic card, generate an access code based on at least the card number of the electronic card, and transmit the access code to the electronic device and the electronic lock device.

The processor of the electronic lock device is configured to:

- in response to an input code from the input interface, compare the input code with the access code;
- transmit an instruction to the electronic device for instructing a user of the electronic device to input the identifying data by means of the electronic card and the input interface and to input a biometric feature as input data;
- receive the input data from the user, access the electronic card to obtain the identifying data, and determine whether the input data matches the identifying data; and
- when it is determined that the input code is identical to the access code and the input data matches the identifying data, control the locking mechanism to switch to the unlocked state.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
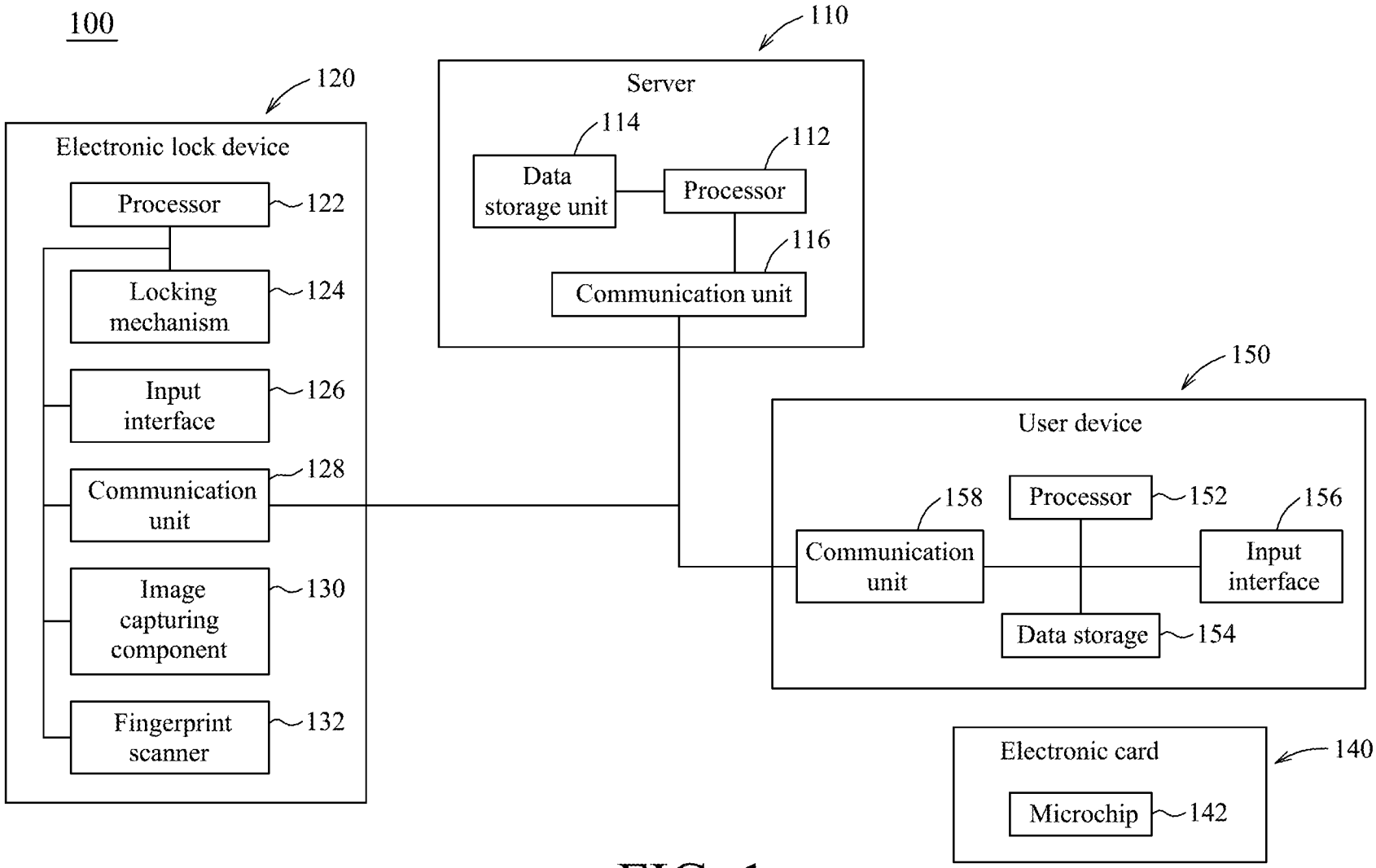
FIG. 1 is a block diagram of a smart access control system according to one embodiment of the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Throughout the disclosure, the term "coupled to" or "connected to" may refer to a direct connection among a plurality of electrical apparatus/devices/equipment via an electrically conductive material (e.g., an electrical wire), or an indirect connection between two electrical apparatus/devices/equipment via another one or more apparatus/devices/equipment, or wireless communication.

FIG. 1 is a block diagram of a smart access control system 100 according to one embodiment of the disclosure.

The smart access control system 100 includes a server 110, an electronic lock device 120 and an electronic card 140. Each of the server 110 and the electronic lock device 120 is configured to communicate with a user device 150.

The server 110 includes a processor 112, a data storage unit 114 coupled to the processor 112, and a communication unit 116 coupled to the processor 112.

The processor 112 may include, but not limited to, a single core processor, a multi-core processor, a dual-core mobile processor, a microprocessor, a microcontroller, a digital signal processor (DSP), a field-programmable gate array (FPGA), an application specific integrated circuit (ASIC), and/or a radio-frequency integrated circuit (RFIC), etc.

The data storage unit 114 may be embodied using, for example, random access memory (RAM), read only memory (ROM), programmable ROM (PROM), firmware, and/or flash memory, etc. In this embodiment, the data storage unit 114 stores a software application that, when executed by the processor 112, causes the processor 112 to perform a number of operations as described below.

The communication unit 116 may include one or more of a radio-frequency integrated circuit (RFIC), a short-range wireless communication module supporting a short-range wireless communication network using a wireless technology of Bluetooth® and/or Wi-Fi, etc., and a mobile communication module supporting telecommunication using Long-Term Evolution (LTE), the third generation (3G) and/or fifth generation (5G) of wireless mobile telecommunications technology, and the like.

The electronic lock device 120 may be installed on a door of a building structure, and includes a processor 122, a locking mechanism 124, an input interface 126 and a communication unit 128.

The processor 122 and the communication unit 128 may be embodied using components that are similar to the processor 112 and the communication unit 116 of the server 110, respectively.

The locking mechanism 124 is configured to switch between a locked state and an unlocked state. As such, when the locking mechanism 124 is in the locked state, the door of the building structure cannot be opened. When the locking mechanism 124 is in the unlocked state, the door of the building structure can be opened.

It is noted that the building structure in this embodiment may be an administrative agency building, an office (a unit or a flat in an office building, a standalone office building or house, or a building in a building complex, etc.), a warehouse, etc. Typically, the building structure may implement access control (AC) to prohibit unauthorized access to the building structure. As such, the locking mechanism 124 typically remains in the locked state, and may need an opening code to be switched to the unlocked state.

The input interface 126 includes a card reader for reading electronic cards, and a keypad for allowing input of a code. Alternatively, the input interface 126 may include the card reader and a touch screen that is configured to display a virtual keypad.

As an example, the keypad may be a number pad, and the code may be a string of numbers. As another example, the virtual keypad may comprise several dots, and the code may be a pattern inputted by connecting at least some of the dots. It is noted that other forms of input interface may be present, and is not limited to the examples described above.

In different embodiments, the electronic lock device 120 may further include an image capturing component 130 that is configured to capture an image, and a fingerprint scanner 132 that is configured to capture a fingerprint.

The user device 150 is held by and associated with a user who may seek access to the building structure. In embodiments, the user device 150 may be embodied using a smartphone, a tablet, a smartwatch, or other portable electronic devices. In this embodiment, the user device 150 includes a processor 152, a data storage 154, an input interface 156 and a communication unit 158.

The processor 152, the data storage 154 and the communication unit 158 of the user device 150 may be embodied using components that are similar to the processor 112, the data storage unit 114 and the communication unit 116 of the server 110, respectively. The input interface 156 may be embodied using a touchscreen.

The data storage 154 stores a software application that, when executed by the processor 152, causes the processor 152 to perform operations as described below.

The electronic card 140 may be a chip-based citizenship card (that is, an electronic identification card issued to a citizen or a national), or other electronic card that includes a microchip 142. The electronic card 140 is configured to communicate with the user device 150 using, for example, near field communication (NFC). The microchip 142 may store a card number and identifying data that are associated with an owner of the electronic card 140 (which is also the user of the user device 150 in one embodiment). It is noted that in the case of an electronic identification card issued to a citizen/national, the card number may be a national identification number (e.g., a 12-digit Vietnamese ID card number) of the citizen/national.

In embodiments, the identifying data is related to a biometric feature of the owner of the electronic card 140 (e.g., the face or fingerprint of the owner). For example, the identifying data may be an image of the face of the owner, fingerprint data of the owner, or other information that can be used to identify the owner of the electronic card 140. In embodiments, the information stored in the electronic card 140 may include name of the owner, date of birth, place of origin (also known as a birthplace), gender, address, a machine readable zone (MRZ) code, etc.

In use, when the user of the user device 150 intends to gain access to the building structure (e.g., to unlock the locking mechanism 124), he/she may operate the user device 150 to initiate an access application process, so as to obtain an access code for unlocking the electronic lock device 120.

Figure 2:
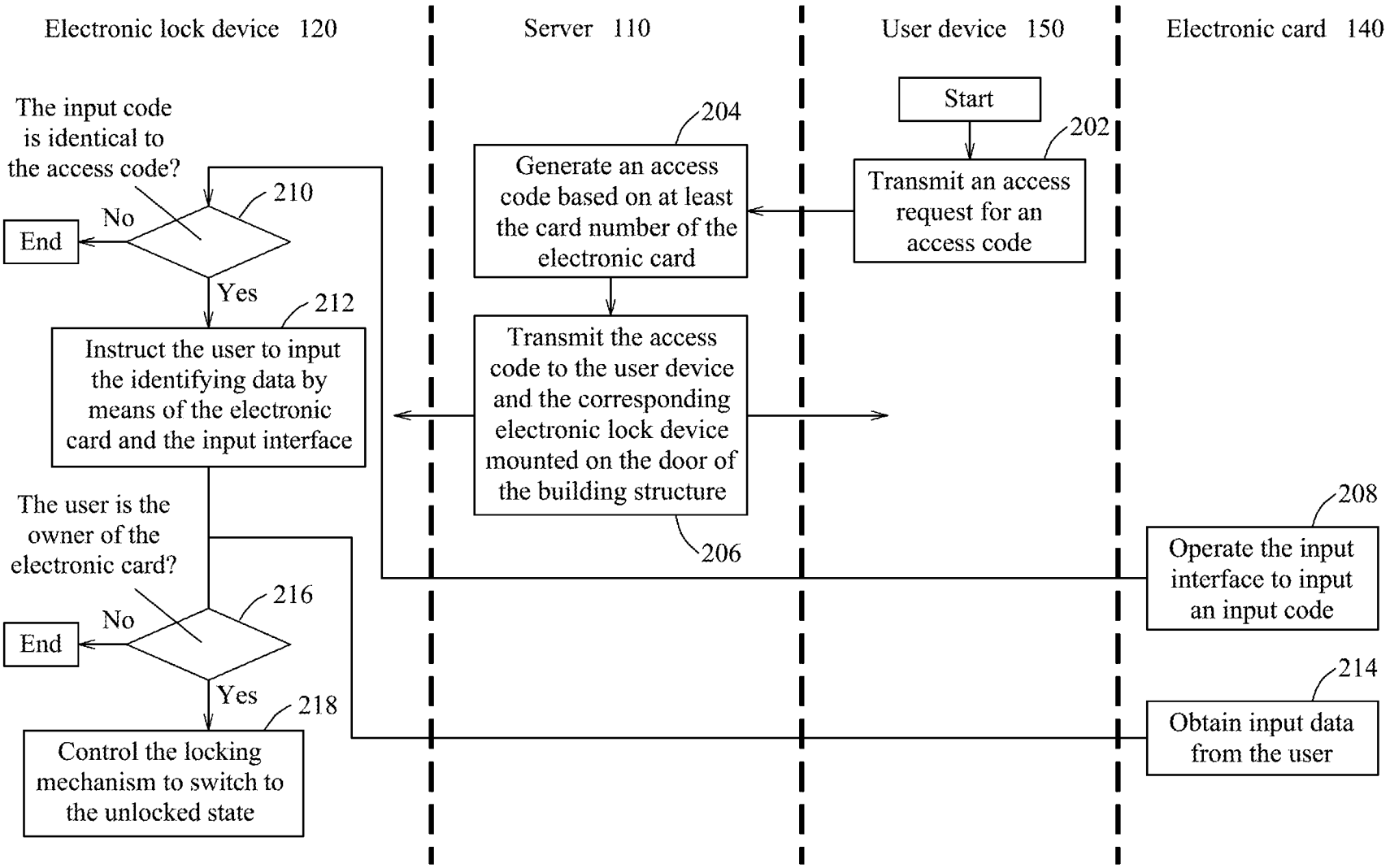
FIG. 2 is a flow chart illustrating steps of a method for unlocking the smart access control system using an electronic card according to one embodiment of the disclosure.

FIG. 2 is a flow chart illustrating steps of a method for unlocking the smart access control system 100 using the electronic card 140, according to one embodiment of the disclosure.

In step 202, the user operates the user device 150 to transmit an access request for an access code that is used to access the building structure. Specifically, the user may log into a website associated with the server 110, or execute an application installed in the user device 150, so as to control the user device 150 to establish communication with the server 110.

During the operations of step 202, in response to the access request, the server 110 may request personal information of the user. For example, in this embodiment, the server 110 may request the card number stored in the electronic card 140. In some embodiments, the user may be required to complete a registration process to apply for access to the building structure, and to provide the card number and/or additional information to the server 110. It is noted that additional security measures may be incorporated into the registration process (e.g., an account number and a password may be required) to ensure that the registration process is actually initiated by the owner of the electronic card 140.

In response to receipt of the access request associated with the electronic card 140 from an electronic device (which in this case is the user device 150), in step 204, the server 110 generates an access code based on at least the card number of the electronic card 140.

In this embodiment, the access code may be a one-time password (OTP) that is generated using an OTP algorithm based on the card number. In addition to the card number, in various embodiments, the access code may be generated further based on one or more of a device code of an electronic device (which is the user device 150 in this case) that sent the access request to the server 110, a time instance at which the access request was received by the server 110 (in the form of a time-stamp), and the MRZ code or other information stored in the electronic card 140.

Then, in step 206, the server 110 transmits the access code to the user device 150 and the corresponding electronic lock device 120 mounted on the door of the building structure where the user intends to gain access to. The transmitting of the access code to the user device 150 may be performed using an SNS (Simple Notification Service) message, and the user device 150 may present the access code on a display thereof.

As a result, the electronic lock device 120 may store the access code therein, and the user is enabled to use the access code received by the user device 150 to gain access to the building structure.

Afterward, the user may proceed to the building structure and attempt to gain access to the building structure by interacting with the electronic lock device 120 mounted on the door.

In step 208, the user may be instructed to input the access code received by the user device 150 in step 206 to the electronic lock device 120 via the input interface 126. The user then operates the input interface 126 to input an input code.

In step 210, in response to the input code from the input interface 126, the processor 122 compares the input code with the access code that was received by the electronic lock device 120 in step 206 from the server 110, and determines whether the input code is identical to the access code.

When it is determined that the input code is not identical to the access code, the processor 122 may generate and output an error message (flashing light, a buzzing sound, a message indicating that the input code is incorrect, etc.), and the process is terminated and the smart access control system 100 denies the user access to the building structure. It is noted that in some embodiments, a plurality of users may have separately requested for an access code, and a plurality of different access codes that are associated with the users, respectively, may have been transmitted to and stored in the electronic lock device 120. In such a case, when it is determined that the input code is not identical to any one of the access codes, the processor 122 generates and outputs the error message, and the process is terminated.

It is noted that in some embodiments, after being generated, the access code may be valid for only a preset limited time period (e.g., 30 minutes). That is to say, in the case that the user inputs the correct access code 30 minutes after the access code was generated, the processor 122 may determine that the access code is no longer valid, and generate and output an error message indicating such. For example, after the access code is received, the processor 122 may activate a timer (not shown in the drawings). After the time period has elapsed, the access code may be deemed invalid.

In some embodiments, during the registration process, a designated time period (e.g., office hour of a specific date) during which the access code will be valid, is determined, for example, by the user. As such, the server 110 may also transmit a designated time period to the electronic lock device 120.

On the other hand, when it is determined that the input code is identical to the access code (or one of the access codes), the flow proceeds to step 212, in which the processor 122 generates and transmits an instruction to the user device 150 for instructing the user to input the identifying data by means of the electronic card 140 and the input interface 126 (e.g., by placing his/her electronic card 140 on or into the card reader of the input interface 126) and to input the biometric feature of the user.

In step 214, the user may input the biometric feature by placing his/her face in front of the image capturing component 130 and/or placing a finger on the fingerprint scanner 132. In response, the image capturing component 130 would capture an image of the user's face, and the fingerprint scanner 132 would capture a fingerprint of the user. The processor 122 then obtains a human face from the image captured by the image capturing component 130. The human face thus obtained by the processor 122 and/or the fingerprint captured by the fingerprint scanner 132 may serve as input data.

It is noted that in different implementations, only one of the human face and the fingerprint is utilized, and in other implementations both the human face and the fingerprint are utilized.

After the user puts his/her electronic card 140 on the card reader, in step 216, the processor 122 accesses the electronic card 140 to obtain the identifying data stored in the electronic card 140, and determines whether the user is the owner of the electronic card 140 by determining whether the input data matches the identifying data (e.g., whether the input data reveals a high enough probability that the source of the input data is the person to whom the identifying data belongs). Specifically, the processor 112 is configured to determine whether the human face matches the image of the face of the user using, for instance, facial recognition techniques, and/or determine whether the fingerprint captured by the fingerprint scanner 132 matches the fingerprint data obtained from the electronic card 140 using, for instance, fingerprint matching techniques. It is noted that the operations of comparing images of human face and fingerprints are well known in the related art, and details thereof are omitted herein for the sake of brevity.

When it is determined that the input data matches the identifying data, the flow proceeds to step 218, in which the processor 122 controls the locking mechanism 124 to switch to the unlocked state. As such, the door is operable to be opened, allowing the user access to the building structure. Otherwise, the processor 122 generates and outputs the error message, and the process is terminated.

It is noted that in different embodiments, the comparison of the input code and the access code and the comparison of the input data and the identifying data may be done in an arbitrary order. That is to say, in other embodiments, the user may be instructed to first input the biometric feature and place his/her electronic card 140 on the card reader. After it is determined that the input data matches the identifying data, the processor 122 then compares the input code with the access code.

It is noted that in some embodiments, for the sake of enhanced security, in response to the input code and placement of the electronic card 140 on the card reader, the processor 122 may further access the electronic card 140 to obtain the card number, and determine whether the input code is generated from the card number. In practice, the processor 122 may execute the OTP algorithm to determine whether the resulting OTP is identical to the input code. When it is determined that the input data matches the identifying data and the input code is generated from the card number and is identical to the access code, the processor 122 controls the locking mechanism 124 to switch to the unlocked state. This configuration may be particularly useful in the scenario that a plurality of access codes are generated by the server 110 and stored in the electronic lock device 120, and a user who has not applied for access code may accidentally entered an input code that is actually one of the access codes.

According to one embodiment of the disclosure, the building structure may be an apartment, a house, a private residence, etc. The electronic lock device 120 may be mounted on door of the building structure. When a visitor intends to visit the building structure, he/she may notify a host (e.g., a resident of the building structure) of the building structure. In response, the host may operate an electronic device (e.g., a personal computer, a laptop in the building structure, etc.) other than the user device 150 to implement the above process.

Specifically, in step 202, the host operates the electronic device to communicate with the server 110, and transmits the card number of the electronic card 140 (belonging to the visitor and not the host) to the server 110.

Then, in step 204, the server 110 generates an access code based on at least the card number of the electronic card 140. Then, in step 206, the server 110 transmits the access code to the electronic lock device 120 and the electronic device, rather than the user device 150.

After receiving the access code, the host may then provide the access code to the user. Then, the user may proceed to the door, and use the access code, the electronic card 140 and the input data to gain access to the building structure (see steps 208-218 of FIG. 2).

To sum up, the embodiments of the disclosure provide a smart access control system 100. The smart access control system 100 employs the server 110 that is configured to, in response to an application from someone (e.g., the user of the user device 150), who provided the card number (which may be an identification number) of an electronic card 140 (which may be belong to said someone or somebody else) to the server 110, generate an access code for opening the electronic lock device 120. Specifically, using the card number and optionally addition information (the device code, the time instance, the MRZ code, etc.), the server 110 may generate an OTP as the access code. Then, the access code may be transmitted to the electronic lock device 120 and the device via which the application was initiated (e.g., the user device 150). With knowledge of the access code, a person wishing to enter the building structure (e.g., the user of the user device 150) is then enabled to interact with the electronic lock device 120 using the access code, his/her electronic card 140 and his/her biometric feature (the image of his/her face and/or a fingerprint). When it is determined that the input code inputted by the user is identical to the access code received from the server 110 (verifying the card number), and that the input data relating to the biometric feature of the person wishing to enter the building structure matches the identifying data stored in the electronic card 140 (verifying the owner of the electronic card 140), the electronic lock device 120 may be unlocked to allow access to the building structure. In such a manner, access control of the building structure may be implemented automatically.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A smart access control system adapted to interact with an electronic card that stores a card number and identifying data associated with an owner of the electronic card, said smart access control system comprising:

a server configured to communicate with an electronic device; and an electronic lock device communicating with the server, the electronic lock device including an input interface, a processor, and a locking mechanism that is configured to switch between a locked state and an unlocked state;

wherein the server is configured to, in response to receipt from the electronic device of an access request that is associated with the electronic card, generate an access code based on at least the card number of the electronic card, and transmitting the access code to the electronic device and the electronic lock device;

wherein the processor of the electronic lock device is configured to in response to an input code from the input interface, compare the input code with the access code, transmit an instruction to the electronic device for instructing a user of the electronic device to input the identifying data by means of the electronic card and the input interface and to input a biometric feature as input data, receive the input data from the user, access the electronic card to obtain the identifying data, and determine whether the input data matches the identifying data, and when it is determined that the input code is identical to the access code and the input data matches the identifying data, control the locking mechanism to switch to the unlocked state.

2. The smart access control system of claim 1, wherein the access code is generated by the server using a one-time password (OTP) algorithm.

3. The smart access control system of claim 2, wherein the access code is generated by the server further based on a device code of the electronic device that sent the access request to the server, and a time instance at which the access request was received by the server.

4. The smart access control system of claim 1, wherein:

the identifying data is an image of the face of an owner of the electronic card; and the electronic lock device further includes an image capturing component that is configured to capture an image of the user, and the processor is configured to obtain a human face from the image captured by the image capturing component, the human face serving as the input data of the user, and determine whether the human face matches the image of the face of the owner of the electronic card.

5. The smart access control system of claim 1, wherein the identifying data is fingerprint data of an owner of the electronic card; and the electronic lock device further includes a fingerprint scanner that is configured to capture a fingerprint serving as the input data, and the processor is configured to determine whether the fingerprint captured by the fingerprint scanner matches the fingerprint data of the user.

6. The smart access control system of claim 1, wherein the electronic card is an electronic identification card issued to the user.

7. The smart access control system of claim 1, wherein the processor of the electronic lock device is further configured to:

access the electronic card to obtain the card number, and determine whether the input code is generated from the card number; and control the locking mechanism to switch to the unlocked state when it is further determined that the input code is generated from the card number.

8. The smart access control system of claim 1, wherein the locking mechanism is disposed on a door, and when the locking mechanism is switched to the unlocked state, the door is operable to be opened.

* * * * *